US010182603B2

(12) United States Patent
Duffy

(10) Patent No.: US 10,182,603 B2
(45) Date of Patent: Jan. 22, 2019

(54) FILTERING FACE-PIECE RESPIRATOR HAVING STRAP-ACTIVATED FOLDED FLANGE

(71) Applicant: 3M INNOVATIVE PROPERTIES COMPANY, St. Paul, MN (US)

(72) Inventor: Dean R. Duffy, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 1068 days.

(21) Appl. No.: 13/727,954

(22) Filed: Dec. 27, 2012

(65) Prior Publication Data

US 2014/0182599 A1 Jul. 3, 2014

(51) Int. Cl.
*A41D 13/11* (2006.01)

(52) U.S. Cl.
CPC ..... *A41D 13/1161* (2013.01); *A41D 13/11* (2013.01); *A41D 13/1115* (2013.01)

(58) Field of Classification Search
CPC ... A41D 13/11; A41D 13/1115; A41D 13/113; A41D 13/1161
USPC ..... 128/863, 206.12, 206.13, 206.19, 206.21
See application file for complete search history.

(56) References Cited

U.S. PATENT DOCUMENTS

| | | | | |
|---|---|---|---|---|
| 3,500,825 | A * | 3/1970 | Andersson et al. | 128/863 |
| 3,971,369 | A | 7/1976 | Aspelin | |
| 3,971,373 | A | 7/1976 | Braun | |
| 4,013,816 | A | 3/1977 | Sabee | |
| 4,215,682 | A | 8/1980 | Kubik | |
| 4,248,220 | A | 2/1981 | White | |
| 4,269,315 | A | 5/1981 | Boyce | |
| RE31,285 | E | 6/1983 | VanTurnhout | |
| 4,536,440 | A | 8/1985 | Berg | |
| 4,550,856 | A | 11/1985 | Ballmann | |
| 4,588,537 | A | 5/1986 | Klaasse | |
| 4,600,002 | A | 7/1986 | Maryyanek | |

(Continued)

FOREIGN PATENT DOCUMENTS

| | | |
|---|---|---|
| CA | 1296487 | 3/1992 |
| EP | 0894443 | 2/1999 |

(Continued)

OTHER PUBLICATIONS

International Application No. PCT/US2013/074254 Search Report dated Mar. 20, 2014.

(Continued)

*Primary Examiner* — Keri J Nelson

(57) ABSTRACT

A filtering face-piece respirator 10 that includes a mask body 12 and a harness 14. The mask body 12 has a major portion 28 that contains one or more layers of filter media 62 and that has first and second flanges 30*a*, 30*b* located on opposing sides of the major portion 28 at first and second lines of demarcation 36*a*, 36*b*. The first and second flanges 30*a*, 30*b* are capable of folding downwardly toward the major portion 28. The harness 14 includes one or more straps 26, 27 that each have first and second ends 29*a*, 29*b*. The first and second straps are secured to the first and second flanges 30*a*, 30*b*, such that there is a strap attachment point spaced at least one centimeter from the line of demarcation. The strap tension and spacing from the line of demarcation causes the flap to be folded downwardly into contact with the major portion to improve crush resistance.

15 Claims, 3 Drawing Sheets

(56) References Cited

U.S. PATENT DOCUMENTS

| | | | |
|---|---|---|---|
| 4,673,084 | A | 6/1987 | Hubbard |
| 4,688,566 | A | 8/1987 | Boyce |
| 4,790,306 | A | 12/1988 | Braun |
| 4,798,850 | A | 1/1989 | Brown |
| 4,807,619 | A | 2/1989 | Dyrud |
| 5,237,986 | A | 8/1993 | Seppala |
| 5,322,061 | A | 6/1994 | Brunson |
| 5,325,892 | A | 7/1994 | Japuntich |
| 5,496,507 | A | 3/1996 | Angadjivand |
| 5,558,089 | A | 9/1996 | Castiglione |
| 5,615,767 | A | 4/1997 | Eull |
| 5,617,849 | A | 4/1997 | Springett |
| 5,656,368 | A | 8/1997 | Braun |
| 5,804,295 | A | 9/1998 | Braun |
| 5,908,598 | A | 6/1999 | Rousseau |
| D412,573 | S | 8/1999 | Castiglione |
| 6,041,782 | A | 3/2000 | Angadjivand |
| 6,062,221 | A | 5/2000 | Brostrom |
| 6,123,077 | A | 9/2000 | Bostock |
| 6,234,171 | B1 | 5/2001 | Springett |
| 6,332,465 | B1 | 12/2001 | Xue |
| 6,336,459 | B1 | 1/2002 | Miyake |
| 6,375,886 | B1 | 4/2002 | Angadjivand |
| 6,391,429 | B1 | 5/2002 | Senkus |
| 6,394,090 | B1 | 5/2002 | Chen |
| 6,397,458 | B1 | 6/2002 | Jones |
| 6,398,847 | B1 | 6/2002 | Jones |
| 6,406,657 | B1 | 6/2002 | Eitzman |
| 6,409,806 | B1 | 6/2002 | Jones |
| 6,454,986 | B1 | 9/2002 | Eitzman |
| 6,484,722 | B2 | 11/2002 | Bostock |
| 6,492,286 | B1 | 12/2002 | Berrigan |
| RE37,974 | E | 2/2003 | Bowers |
| 6,568,392 | B1 | 5/2003 | Bostock |
| 6,743,464 | B1 | 6/2004 | Insley |
| 6,763,970 | B2 | 7/2004 | Harris |
| 6,783,574 | B1 | 8/2004 | Angadjivand |
| 6,824,718 | B2 | 11/2004 | Eitzman |
| 6,843,248 | B2 | 1/2005 | Japuntich |
| 6,854,463 | B2 | 2/2005 | Japuntich |
| 6,868,984 | B2 | 3/2005 | Griesbach |
| 6,883,518 | B2 | 4/2005 | Mittelstadt |
| 6,923,182 | B2 | 8/2005 | Angadjivand |
| 7,013,895 | B2 | 3/2006 | Martin |
| 7,028,689 | B2 | 4/2006 | Martin |
| 7,036,507 | B2 | 5/2006 | Jensen |
| 7,117,868 | B1 | 10/2006 | Japuntich |
| 7,131,442 | B1 | 11/2006 | Kronzer |
| RE39,493 | E | 2/2007 | Yuschak |
| 7,188,622 | B2 | 3/2007 | Martin |
| 7,311,104 | B2 | 12/2007 | Japuntich |
| 7,428,903 | B1 | 9/2008 | Japuntich |
| 7,677,248 | B2 | 3/2010 | Gerson |
| 7,766,015 | B2 | 8/2010 | Harold |
| 8,066,006 | B2 | 11/2011 | Daugaard |
| D659,821 | S | 5/2012 | Spoo |
| 2004/0221849 | A1 | 11/2004 | Shue |
| 2005/0098182 | A1 | 5/2005 | Callan |
| 2007/0044803 | A1 | 3/2007 | Xue |
| 2007/0068529 | A1 | 3/2007 | Kalatoor |
| 2007/0210096 | A1 | 9/2007 | Ellswood |
| 2007/0267022 | A1 | 11/2007 | Chiam |
| 2008/0271737 | A1 | 6/2008 | Facer |
| 2009/0044812 | A1 | 2/2009 | Welchel |
| 2009/0078265 | A1 | 3/2009 | Skulley |
| 2009/0078266 | A1 | 3/2009 | Mattano |
| 2010/0154805 | A1 | 6/2010 | Duffy |
| 2010/0154806 | A1 | 6/2010 | Duffy |
| 2011/0067700 | A1 | 3/2011 | Spoo |
| 2011/0094515 | A1 | 4/2011 | Duffy |
| 2011/0315144 | A1 | 12/2011 | Eitzman |

FOREIGN PATENT DOCUMENTS

| | | |
|---|---|---|
| EP | 1495785 | 1/2005 |
| EP | 1737316 | 1/2007 |
| GB | 2103491 | 2/1983 |
| WO | WO 1996/28216 | 9/1996 |

OTHER PUBLICATIONS

U.S. Appl. No. 13/727,923 to Duffy filed Dec. 27, 2012, entitled *Filtering Face-Piece Respirator Having Folded Flange*.

U.S. Appl. No. 13/727,983 to Duffy filed Dec. 27, 2012, entitled *Filtering Face-Piece Respirator Having Welded Indicia Hidden in Pleat*.

U.S. Appl. No. 13/728,008 to Duffy filed Dec. 27, 2012, entitled *Filtering Face-Piece Respirator Having Rounded Perimeter*.

U.S. Appl. No. 29/440,780 to Duffy filed Dec. 27, 2012, entitled *Respiratory Mask Having Flange Outline*.

U.S. Appl. No. 29/440,788 to Duffy filed Dec. 27, 2012, entitled *Respiratory Mask with Weld Line*.

Davies,C.N.,"The Separation of Airborne Dust Particles", Institution of Mechanical Engineers, London, Proceedings 1B, 1952 pp. 185-198.

Wente,Van A.,"Superfine Thermoplastic Fibers", Industrial and Engineering Chemistry, Aug. 1956, vol. 48, No. 8, pp. 1342-1346.

* cited by examiner

FILTERING FACE-PIECE RESPIRATOR HAVING STRAP-ACTIVATED FOLDED FLANGE

The present invention pertains to a filtering face-piece respirator that has a folded external flange, which flange has a leading edge that matches a perimeter segment of the mask body.

BACKGROUND

Respirators are commonly worn over a person's breathing passages for at least one of two common purposes: (1) to prevent impurities or contaminants from entering the wearer's respiratory system; and (2) to protect other persons or things from being exposed to pathogens and other contaminants exhaled by the wearer. In the first situation, the respirator is worn in an environment where the air contains particles that are harmful to the wearer, for example, in an auto body shop. In the second situation, the respirator is worn in an environment where there is risk of contamination to other persons or things, for example, in an operating room or clean room.

A variety of respirators have been designed to meet either (or both) of these purposes. Some respirators have been categorized as being "filtering face-pieces" because the mask body itself functions as the filtering mechanism. Unlike respirators that use rubber or elastomeric mask bodies in conjunction with attachable filter cartridges (see, e.g., U.S. Pat. RE39,493 to Yuschak et al.) or insert-molded filter elements (see, e.g., U.S. Pat. No. 4,790,306 to Braun), filtering face-piece respirators are designed to have the filter media cover much of the whole mask body so that there is no need for installing or replacing a filter cartridge. These filtering face-piece respirators commonly come in one of two configurations: molded respirators and flat-fold respirators.

Molded filtering face piece respirators have regularly comprised non-woven webs of thermally-bonding fibers or open-work plastic meshes to furnish the mask body with its cup-shaped configuration. Molded respirators tend to maintain the same shape during both use and storage. These respirators therefore cannot be folded flat for storage and shipping. Examples of patents that disclose molded, filtering, face-piece respirators include U.S. Pat. No. 7,131,442 to Kronzer et al, U.S. Pat. Nos. 6,923,182, 6,041,782 to Angadjivand et al., U.S. Pat. No. 4,807,619 to Dyrud et al., and U.S. Pat. No. 4,536,440 to Berg.

Flat-fold respirators—as their name implies—can be folded flat for shipping and storage. They also can be opened into a cup-shaped configuration for use. Examples of flat-fold respirators are shown in U.S. Pat. Nos. 6,568,392 and 6,484,722 to Bostock et al., and U.S. Pat. No. 6,394,090 to Chen.

Although flat-fold respirators are convenient in that they can be folded flat for shipping and storage, these respirators tend to have more difficulty in maintaining their cup-shaped configuration during use. Accordingly, investigators who design flat-fold respirators have provided these masks with weld lines, seams, and folds, to help maintain their cup-shaped configuration during use. Stiffening members also have been incorporated into panels of the mask body (see U.S. Patent Application Publications 2001/0067700 to Duffy et al., 2010/0154805 to Duffy et al., and U.S. Design Pat. 659,821 to Spoo et al.). The present invention, as described below, provides yet another method of improving the structural integrity of a non-molded filtering face mask during use, and also provides a respiratory mask that has a clean appearance.

SUMMARY OF THE INVENTION

The present invention provides a filtering face-piece respirator that comprises a mask body and a harness. The mask body has a major portion that contains one or more layers of filter media and that has first and second flanges located on opposing sides of the major portion. The first and second flanges are capable of folding inwardly towards the major portion. The harness comprises two straps that each have first and second ends. The first and second ends are secured to the first and second flanges, respectively, such that there are two ends secured to each flap in a spaced apart relationship so that the straps have a first segment that follows a path above the wearer's ear and a second segment that follows a path below the wearer's ear when the respirator is being donned. The second strap is placed in tension when the respirator is donned, and wherein such tension causes the flap to be folded downwardly into contact with the major portion.

The present invention also provides a filtering face-piece respirator that comprises a mask body and a harness. The mask body comprises a major portion that contains one or more layers of filter media and that has first and second flanges located on opposing sides of the major portion. The first and second flanges each being capable of being folded downwardly towards the major portion at a line of demarcation. The harness also comprises first and second straps that each have first and second ends. The first and second ends of the second strap being secured to the first and second flanges, respectively, such that each point of securement is spaced at least one centimeter from the line of demarcation. At least the second straps is placed in tension when the respirator is donned, and wherein this tension causes the flap to be folded downwardly into contact with the major portion.

The present invention is beneficial in that it creates a stiff cup-shaped mask body that has extraordinary structural integrity or collapse resistance during use.

GLOSSARY

The terms set forth below will have the meanings as defined:

"comprises (or comprising)" means its definition as is standard in patent terminology, being an open-ended term that is generally synonymous with "includes", "having", or "containing" Although "comprises", "includes", "having", and "containing" and variations thereof are commonly-used, open-ended terms, this invention also may be suitably described using narrower terms such as "consists essentially of", which is semi open-ended term in that it excludes only those things or elements that would have a deleterious effect on the performance of the inventive respirator in serving its intended function;

"clean air" means a volume of atmospheric ambient air that has been filtered to remove contaminants;

"contaminants" means particles (including dusts, mists, and fumes) and/or other substances that generally may not be considered to be particles (e.g., organic vapors, et cetera) but which may be suspended in air;

"crosswise dimension" is the dimension that extends laterally across the respirator, from side-to-side when the respirator is viewed from the front;

"cup-shaped configuration" means any vessel-type shape that is capable of adequately covering the nose and mouth of a person;

"exterior gas space" means the ambient atmospheric gas space into which exhaled gas enters after passing through and beyond the mask body and/or exhalation valve;

"filtering face-piece" means that the mask body itself is designed to filter air that passes through it; there are no separately identifiable filter cartridges or insert-molded filter elements attached to or molded into the mask body to achieve this purpose;

"filter" or "filtration layer" means one or more layers of air-permeable material, which layer(s) is adapted for the primary purpose of removing contaminants (such as particles) from an air stream that passes through it;

"filter media" means an air-permeable structure that is designed to remove contaminants from air that passes through it;

"filtering structure" means a generally air-permeable construction that filters air;

"first side" means an area of the mask body that is located on one side of a plane that bisects the mask body normal to the cross-wise dimension;

"flange" means a protruding part that imparts structural integrity or strength to the body from which it protrudes;

"folded inwardly" means being bent back towards the part from which extends;

"frontally" means extending away from the mask body perimeter;

"harness" means a structure or combination of parts that assists in supporting the mask body on a wearer's face;

"integral" means being manufactured together at the same time; that is, being made together as one part and not two separately manufactured parts that are subsequently joined together;

"interior gas space" means the space between a mask body and a person's face;

"leading edge" an unattached edge;

"line of demarcation" means a fold, seam, weld line, bond line, stitch line, hinge line, and/or any combination thereof;

"major portion" means the cup-shaped portion of the mask body;

"mask body" means an air-permeable structure that is designed to fit over the nose and mouth of a person and that helps define an interior gas space separated from an exterior gas space (including the seams and bonds that join layers and parts thereof together);

"match" means to substantially follow a similar path as;

"nose clip" means a mechanical device (other than a nose foam), which device is adapted for use on a mask body to improve the seal at least around a wearer's nose;

"perimeter" means the outer edge of the mask body, which outer edge would be disposed generally proximate to a wearer's face when the respirator is being donned by a person;

"pleat" means a portion that is designed to be or is folded back upon itself;

"polymeric" and "plastic" each mean a material that mainly includes one or more polymers and that may contain other ingredients as well;

"plurality" means two or more;

"respirator" means an air filtration device that is worn by a person to provide the wearer with clean air to breathe;

"second side" means an area of the mask body that is located on one side of a plane that bisects the mask body normal to the cross-wise dimension (the second side being opposite the first side);

"snug fit" or "fit snugly" means that an essentially air-tight (or substantially leak-free) fit is provided (between the mask body and the wearer's face);

"tab" means a part that exhibits sufficient surface area for attachment of another component; and "transversely extending" means extending generally in the crosswise dimension.

DETAILED DESCRIPTION OF PREFERRED EMBODIMENTS

In practicing the present invention, a filtering face-piece respirator is provided that has first and second flanges disposed on first and second opposing sides of the mask body. The first and second flanges have been discovered to be beneficial in providing improved structural integrity to the mask body to keep it in a spaced, cup-shaped configuration, away from the wearer's mouth during use. Flat-fold respirators are not molded into a permanent face-fitting shape, and therefore they may have a tendency to lose their desired face-fitting configuration after being worn for extended time periods. The wearer, for example, may inadvertently cause the mask body to bump into external objects during use. The moisture in the warm, exhaled air, and in the surrounding environment, may contribute to loss of mask rigidity which may allow the mask body interior to contact the wearer's face. The provision of first and second flanges, which are folded inwardly to contact the major portion of the mask body, assist in maintaining the desired off-the-face, cup-shaped face configuration during use.

Figure 1:
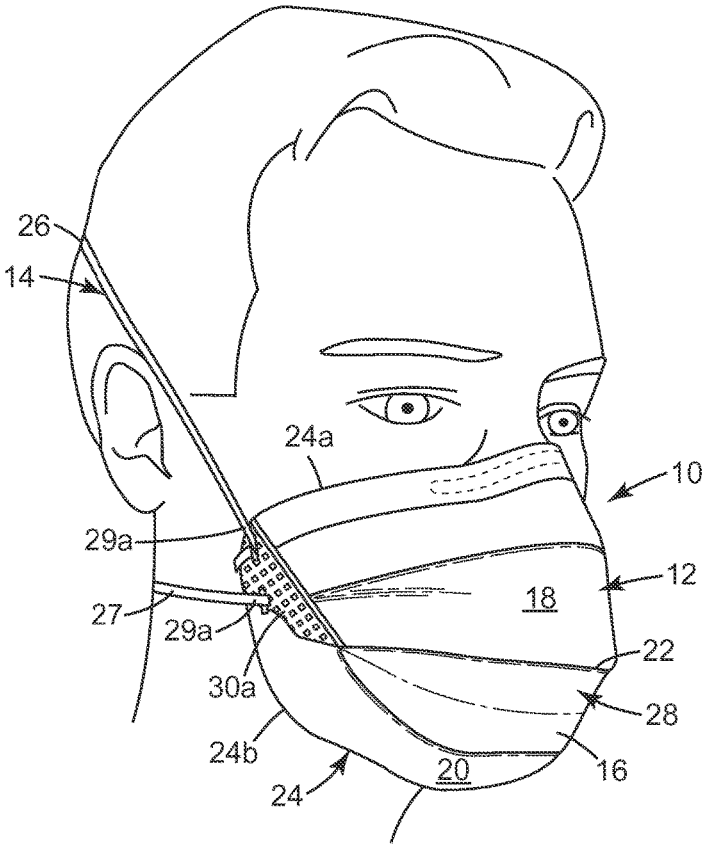
FIG. 1 is a front perspective view of a flat-fold filtering face-piece respirator 10, in accordance with the present invention, being worn on a person's face.
Figure 2:
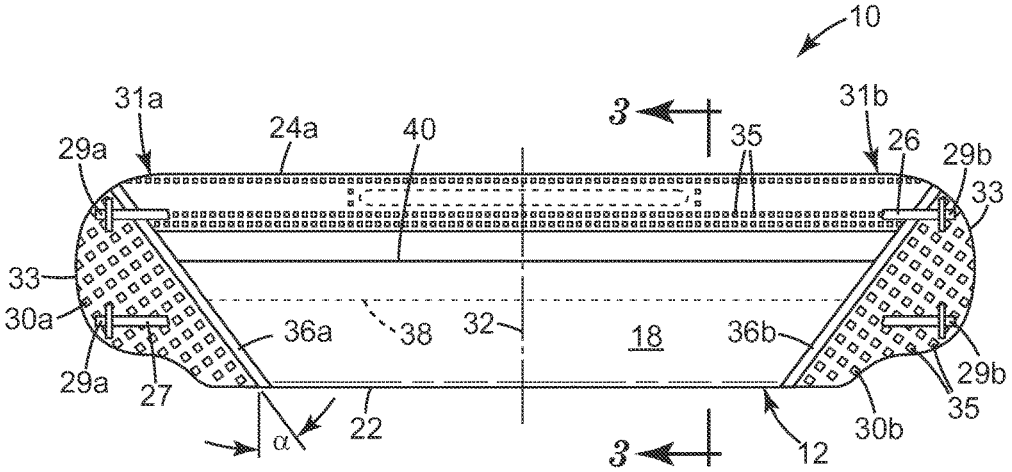
FIG. 2 is a top view of the respirator 10 shown in FIG. 1 in a non-opened configuration.

FIG. 1 shows an example of a filtering face-piece respirator 10 that may be used in connection with the present invention to provide clean air for the wearer to breathe. The filtering face-piece respirator 10 includes a mask body 12 and a harness 14. The mask body 12 has a filtering structure 16 through which inhaled air must pass before entering the wearer's respiratory system. The filtering structure 16 removes contaminants from the ambient environment so that the wearer breathes clean air. The mask body 12 includes a top portion 18 and a bottom portion 20. The top portion 18 and the bottom portion 20 are separated by a line of demarcation 22. In this particular embodiment, the line of demarcation 22 is a fold or pleat that extends transversely across the central portion of the mask body from side-to-side. The mask body 12 also includes a perimeter 24 that includes an upper segment 24*a* and a lower segment 24*b*. The harness 14 has a first, upper strap 26 that is secured to a first flange 30*a*. The harness 14 also has a second, lower strap 27 that is secured to the first flange 30*a* as well. There is a second flange 30*b* (FIG. 2) located on an opposing side of the major portion 28 of the mask body 12. The first and second flanges 30*a*, 30*b* are capable of folding inwardly towards the major portion 28. The harness straps 26, 27 each have first and second ends 29*a*, 29*b* (FIG. 2). The first and second ends 29*a*, 29*b* are secured to the first and second flanges 30*a*, 30*b*, respectively, such that there are two ends 29*a*, 29*b* secured to each flap 30*a*, 30*b* in a spaced apart relationship so that the first strap 26 has a first segment that follows a path above the wearer's ear and the second strap 27 has a second segment that follows a path below the wearer's ear when the respirator is being donned. The straps 26, 27 are each placed in tension when the respirator is donned, and such tension, particularly the tension on strap 27, causes the flaps 30*a*, 30*b* to be folded downwardly into contact with the major portion 28 of mask body 12 during respirator use.

FIG. 2 shows that the first and second flanges 30*a* and 30*b* are located on opposing sides 31*a* and 31*b*, respectively, of the mask body 12. A plane 32 bisects the mask body 12 to define the first and second sides 31*a*, 31*b*. The first and second straps 26, 27 are each attached to flanges 30*a*, 30*b*. In use, the tension on second strap 27 causes the flanges 30*a* and 30*b* to be folded inwardly towards the filtering structure 16 in contact with it when the respirator 12 is worn over the nose and mouth of the user. Each flange typically occupies a surface area of about 1 to 15 square cm, more typically about 2 to 12 square cm, and still more typically about 5 to 10 square cm. The flanges 30*a*, 30*b* can be integrally or non-integrally secured to the major portion 28 of the mask body 12, and they can have welds or bonds 35 provided thereon to increase flange stiffness. Alternatively, an adhesive layer may be used to increase flange stiffness. The flanges may have a flexural modulus of at least 10 Mega Pascals (MPa), more typically at least 20 MPa when bent along a major surface of the flange. At the upper end, the flexural modulus is typically less than 100 MPa, more typically less than 60 MPa. The flanges 30*a*, 30*b* also typically extend away from a demarcation line 36*a*, 36*b* on the mask body 12 at least 2 millimeters (mm), more typically at least 5 mm, and still more typically at least 1 to 2 cm. The flanges 30*a*, 30*b* may comprise one or more or all of the various layers that comprise the mask body filtering structure 16. Unlike the filtering structure 16, the layers that comprise the flanges 30*a*, 30*b* may be compressed, rendering them nearly fluid impermeable. The flanges 30*a*, 30*b* may be an extension of the material used to make the mask body filtering structure 16, or they may be made from a separate material such as a rigid or semi-rigid plastic. The mask body perimeter 24*a* also may have a series of bonds or welds 35 to join the various layers of the mask body 12 together. The perimeter therefore may not be very fluid permeable. The remainder of the filtering structure 16—inwardly from the perimeter—may be fully fluid permeable over much of its extended surface, with the possible exception of areas where there are bonds, welds, or fold lines. The first and second flanges 30*a*, 30*b* may be joined to the mask body 12 at the first and second lines of demarcation 36*a*, 36*b* and may be rotated or folded about an axis generally parallel to these demarcation lines, respectively. The first and second ends 29*a*, 29*b* (FIG. 2) of each of the straps 26, 27 are secured to each of the flanges 30*a*, 30*b* in a line generally parallel to the leading edges 33. The flanges 30*a*, 30*b* may meet the major portion 28 of the mask body 12 at the line of demarcation 36*a*, 36*b*. The second strap 27 securement point is spaced at least one centimeter from the line of demarcation 36*a*, 36*b*. This spacing of the strap securement point from the line of demarcation creates a lever arm that enables the flange to be securely folded against the major portion 28 when the respirator 10 is worn. The line of demarcation typically is at least three centimeters (cm) long. More typically, the strap that exerts the tension causing the downward folding of the flange is spaced 1.5 cm or more from the line of demarcation 36*a*, 36*b*. The upper securement point is typically spaced a distance less than 1 cm from the line of demarcation 36*a*, 36*b*.

The first and second lines of demarcation 36*a*, 36*b* are off-set at an angle $\alpha$from a plane 32 that extends perpendicular to the perimeter 24*a* of the mask body 12 when viewing the mask body from a top or bottom view in a non-opened condition. The angle a may be from about zero to about 60 degrees, more typically about 30 to 45 degrees. The top portion 18 may include one or more pleat lines 38 that extend from the first line of demarcation 36*a* to the second line of demarcation 36*b* transversely.

Figure 3:
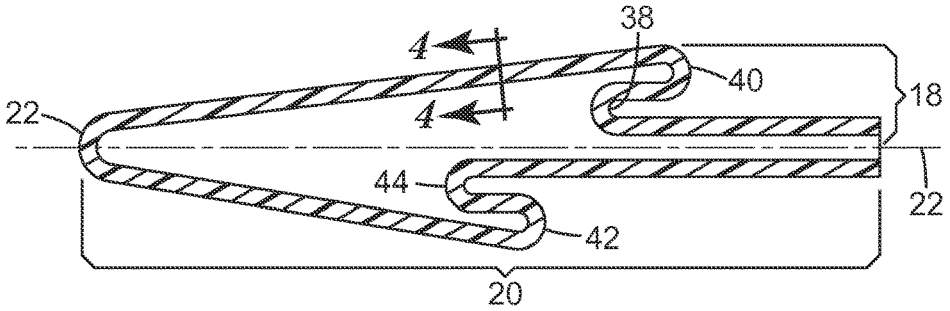
FIG. 3 is a cross-sectional view of the mask body 12 taken along lines 3-3 of FIG. 2.

FIG. 3 illustrates an example of a pleated configuration of a mask body 12 in accordance with the present invention. As shown, the upper portion or panel 18 of the mask body 12 also may include pleats 38 and 40 and half of pleat 22. The lower portion or panel 20 of the mask body 12 may include pleats 42 and 44 and half of pleat 22. Pleat 22 separates the upper and lower portions 18 and 20 of mask body 12. The lower portion 20 of the mask body 12 may include the same, more, or less filter media surface area than the upper portion 18. The mask body 12 also may include a perimeter web that is secured to the mask body along its perimeter. The perimeter web may be folded over the mask body at the perimeter 24*a*, 24*b*. The perimeter web may also be an extension of the inner cover web folded and secured around the edge of 24*a* and 24*b*. A nose clip 56 (FIG. 5) may be disposed on the upper portion 18 of the mask body centrally adjacent to the perimeter segment 24*a* between the filtering structure 16 and the perimeter web. The nose clip 56 may be made from a pliable metal or plastic that is capable of being manually adapted by the wearer to fit the contour of the wearer's nose.

Figure 4:
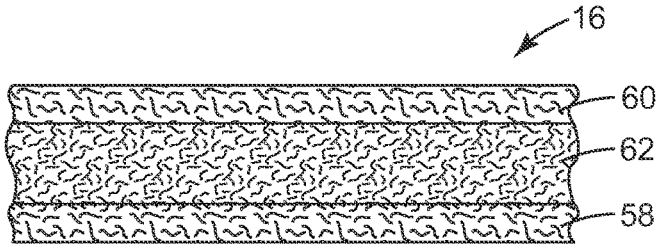
FIG. 4 is a cross-sectional view of the filtering structure 16 taken along lines 4-4 of FIG. 3.

FIG. 4 shows that the filtering structure 16 may include one or more layers such as an inner cover web 58, an outer cover web 60, and a filtration layer 62. The inner and outer cover webs 58 and 60 may be provided to protect the filtration layer 62 and to preclude fibers from the filtration layer 62 from coming loose and entering the mask interior. During respirator use, air passes sequentially through layers 60, 62, and 58 before entering the mask interior. The air that is disposed within the interior gas space of the mask body may then be inhaled by the wearer. When a wearer exhales, the air passes in the opposite direction sequentially through layers 58, 62, and 60. Alternatively, an exhalation valve (not shown) may be provided on the mask body to allow exhaled air to be rapidly purged from the interior gas space to enter the exterior gas space without passing through filtering structure 16. Typically, the cover webs 58 and 60 are made from a selection of nonwoven materials that provide a comfortable feel, particularly on the side of the filtering structure that makes contact with the wearer's face. The construction of various filter layers and cover webs that may be used in conjunction with the support structure of the present invention are described below in more detail. The filtering structure also may have a structural netting or mesh juxtaposed against at least one or more of the layers 58, 60, or 62, typically against the outer surface of the outer cover web 60. The use of such a mesh is described in U.S. Patent Application Publication No. 2010/0154806A1, entitled *Expandable Face Mask with Reinforcing Netting*. To improve wearer fit and comfort, an elastomeric face seal can be secured to the perimeter of the filtering structure 16. Such a face seal may extend radially inward to contact the wearer's face when the respirator is being donned. Examples of face seals are described in U.S. Pat. No. 6,568,392 to Bostock et al., U.S. Pat. No. 5,617,849 to Springett et al., and U.S. Pat. No. 4,600,002 to Maryyanek et al., and in Canadian Patent 1,296,487 to Yard. The mask body perimeter 24 also may be folded upon itself in the nose region to achieve a snug fit—see U.S. Patent Application Publication 2011/0315144A1.

Figure 5:
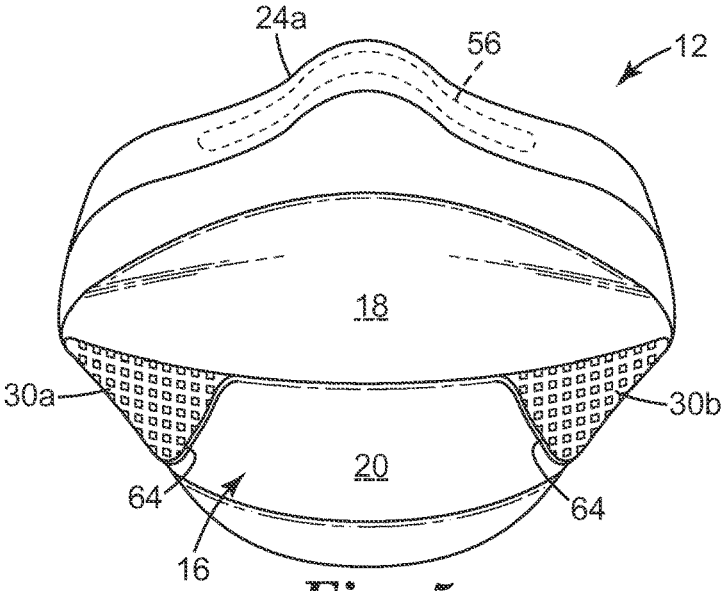
FIG. 5 is a front view of the mask body 12, which may be used in connection with the present invention.

FIG. 5 shows the mask body 12 in an in-use configuration. During use, the flanges 30*a*, 30*b* are disposed in contact with the first and second sides of the major portion 28 of mask body 12. The flanges 30*a*, 30*b* may be folded inwardly towards the mask body. When the flange is pulled in towards the major portion 28 of the mask body 12, the respirator behaves as a molded respirator rather than a flat-fold respirator. That is, the respirator takes on a structural cup-shaped configuration better capable of better maintaining that shape during use. Thus, a respirator of the invention, having the flanges 30*a*, 30*b*, pulled in towards the major portion 28 of the mask body 12 is, in a sense, a hybrid between a molded respirator and a flat-fold respirator.

Figure 6:
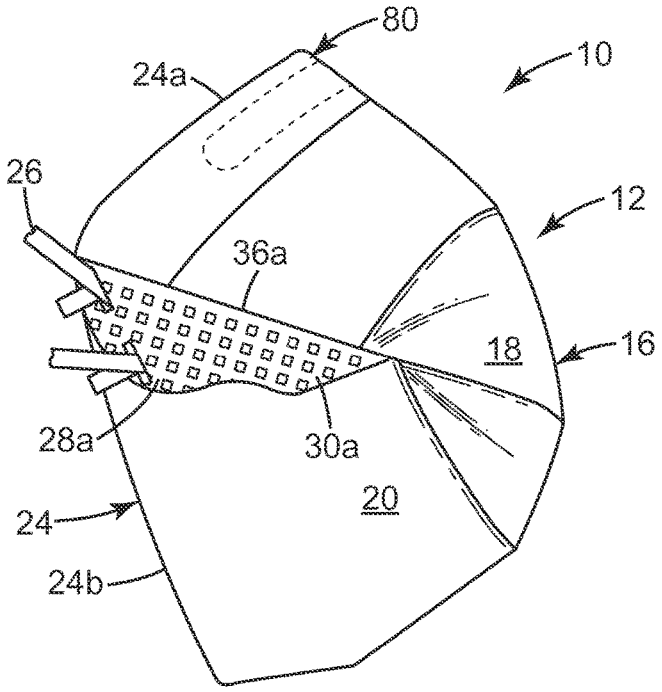
FIG. 6 is a left side view of the respirator 10 in accordance with the present invention.

FIG. 6 too shows the flange 30*a* folded downwardly in contact with the bottom portion 20 of the filtering structure 16 of mask body 12. The flange extension along line 36*a* and its in-contact placement with the bottom portion 20 of the filtering structure 16 contribute to the illustrated off-the-face, cup-shaped configuration. The mask body 12 can maintain this desired shape during many hours of use in a moist environment without risk of collapse The Filtering Structure The filtering structure that is used in connection with the present invention may take on a variety of different shapes and configurations. The filtering structure typically is adapted so that it properly fits against or within the support structure. Generally the shape and configuration of the filtering structure corresponds to the general shape of the mask body. Although a filtering structure has been illustrated with multiple layers that include a filtration layer and two cover webs, the filtering structure may simply comprise a filtration layer or a combination of filtration layers. For example, a pre-filter may be disposed upstream to a more refined and selective downstream filtration layer. Additionally, sorptive materials such as activated carbon may be disposed between the fibers and/or various layers that comprise the filtering structure. Further, separate particulate filtration layers may be used in conjunction with sorptive layers to provide filtration for both particulates and vapors. The filtering structure may include one or more stiffening layers that assist in providing a cup-shaped configuration. The filtering structure also could have one or more horizontal and/or vertical lines of demarcation that contribute to its structural integrity. The first and second flanges when used in accordance with the present invention, however, may make unnecessary the need for such stiffening layers and lines of demarcation.

The filtering structure that is used in a mask body of the invention can be of a particle capture or gas and vapor type filter. The filtering structure also may be a barrier layer that prevents the transfer of liquid from one side of the filter layer to another to prevent, for instance, liquid aerosols or liquid splashes (e.g. blood) from penetrating the filter layer. Multiple layers of similar or dissimilar filter media may be used to construct the filtering structure of the invention as the application requires. Filters that may be beneficially employed in a layered mask body of the invention are generally low in pressure drop (for example, less than about 195 to 295 Pascals at a face velocity of 13.8 centimeters per second) to minimize the breathing work of the mask wearer. Filtration layers additionally may be flexible and may have sufficient shear strength so that they generally retain their structure under the expected use conditions. Examples of particle capture filters include one or more webs of fine inorganic fibers (such as fiberglass) or polymeric synthetic fibers. Synthetic fiber webs may include electret-charged, polymeric microfibers that are produced from processes such as meltblowing. Polyolefin microfibers formed from polypropylene that has been electrically-charged provide particular utility for particulate capture applications. An alternate filter layer may comprise a sorbent component for removing hazardous or odorous gases from the breathing air. Sorbents may include powders or granules that are bound in a filter layer by adhesives, binders, or fibrous structures—see U.S. Pat. No. 6,334,671 to Springett et al. and U.S. Pat. No. 3,971,373 to Braun. A sorbent layer can be formed by coating a substrate, such as fibrous or reticulated foam, to form a thin coherent layer. Sorbent materials may include activated carbons that are chemically treated or not, porous alumna-silica catalyst substrates, and alumna particles. An example of a sorptive filtration structure that may be conformed into various configurations is described in U.S. Pat. No. 6,391,429 to Senkus et al.

The filtration layer is typically chosen to achieve a desired filtering effect. The filtration layer generally will remove a high percentage of particles and/or or other contaminants from the gaseous stream that passes through it. For fibrous filter layers, the fibers selected depend upon the kind of substance to be filtered and, typically, are chosen so that they do not become bonded together during the molding operation. As indicated, the filtration layer may come in a variety of shapes and forms and typically has a thickness of about 0.2 millimeters (mm) to 1 centimeter (cm), more typically about 0.3 mm to 0.5 cm, and it could be a generally planar web or it could be corrugated to provide an expanded surface area—see, for example, U.S. Pat. Nos. 5,804,295 and 5,656,368 to Braun et al. The filtration layer also may include multiple filtration layers joined together by an adhesive or any other means. Essentially any suitable material that is known (or later developed) for forming a filtering layer may be used as the filtering material. Webs of melt-blown fibers, such as those taught in Wente, Van A., *Superfine Thermoplastic Fibers,* 48 Indus. Engn. Chem., 1342 et seq. (1956), especially when in a persistent electrically charged (electret) form are especially useful (see, for example, U.S. Pat. No. 4,215,682 to Kubik et al.). These melt-blown fibers may be microfibers that have an effective fiber diameter less than about 20 micrometers (μm) (referred to as BMF for "blown microfiber"), typically about 1 to 12 μm. Effective fiber diameter may be determined according to Davies, C. N., *The Separation Of Airborne Dust Particles*, Institution Of Mechanical Engineers, London, Proceedings 1B, 1952. Particularly preferred are BMF webs that contain fibers formed from polypropylene, poly(4-methyl-1-pentene), and combinations thereof. Electrically charged fibrillated-film fibers as taught in van Turnhout, U.S. Pat. Re. 31,285, also may be suitable, as well as rosin-wool fibrous webs and webs of glass fibers or solution-blown, or electrostatically sprayed fibers, especially in microfilm form. Electric charge can be imparted to the fibers by contacting the fibers with water as disclosed in U.S. Pat. No. 6,824,718 to Eitzman et al., U.S. Pat. No. 6,783,574 to Angadjivand et al., U.S. Pat. No. 6,743,464 to Insley et al., U.S. Pat. Nos. 6,454,986 and 6,406,657 to Eitzman et al., and U.S. Pat. Nos. 6,375,886 and 5,496,507 to Angadjivand et al. Electric charge also may be imparted to the fibers by corona charging as disclosed in U.S. Pat. No. 4,588,537 to Klasse et al. or by tribocharging as disclosed in U.S. Pat. No. 4,798,850 to Brown. Also, additives can be included in the fibers to enhance the filtration performance of webs produced through the hydrocharging process (see U.S. Pat. No. 5,908,598 to Rousseau et al.). Fluorine atoms, in particular, can be disposed at the surface of the fibers in the filter layer to improve filtration performance in an oily mist environment—see U.S. Pat. Nos. 6,398,847 B1, 6,397,458 B1, and 6,409,806 B1 to Jones et al. Typical basis weights for electret BMF filtration layers are about 10 to 100 grams per square meter. When electrically charged according to techniques described in, for example, the '507 Angadjivand et al. patent, and when including fluorine atoms as mentioned in the Jones et al. patents, the basis weight may be about 20 to 40 g/m$^2$ and about 10 to 30 g/m$^2$, respectively.

An inner cover web can be used to provide a smooth surface for contacting the wearer's face, and an outer cover web can be used to entrap loose fibers in the mask body or for aesthetic reasons. The cover web typically does not provide any substantial filtering benefits to the filtering structure, although it can act as a pre-filter when disposed on the exterior (or upstream to) the filtration layer. To obtain a suitable degree of comfort, an inner cover web preferably has a comparatively low basis weight and is formed from comparatively fine fibers. More particularly, the cover web may be fashioned to have a basis weight of about 5 to 50 g/m$^2$ (typically 10 to 30 g/m$^2$), and the fibers may be less than 3.5 denier (typically less than 2 denier, and more typically less than 1 denier but greater than 0.1). Fibers used in the cover web often have an average fiber diameter of about 5 to 24 micrometers, typically of about 7 to 18 micrometers, and more typically of about 8 to 12 micrometers. The cover web material may have a degree of elasticity (typically, but not necessarily, 100 to 200% at break) and may be plastically deformable.

Suitable materials for the cover web may be blown microfiber (BMF) materials, particularly polyolefin BMF materials, for example polypropylene BMF materials (including polypropylene blends and also blends of polypropylene and polyethylene). A suitable process for producing BMF materials for a cover web is described in U.S. Pat. No. 4,013,816 to Sabee et al. The web may be formed by collecting the fibers on a smooth surface, typically a smooth-surfaced drum or a rotating collector—see U.S. Pat. No. 6,492,286 to Berrigan et al. Spun-bond fibers also may be used.

A typical cover web may be made from polypropylene or a polypropylene/polyolefin blend that contains 50 weight percent or more polypropylene. These materials have been found to offer high degrees of softness and comfort to the wearer and also, when the filter material is a polypropylene BMF material, to remain secured to the filter material without requiring an adhesive between the layers. Polyolefin materials that are suitable for use in a cover web may include, for example, a single polypropylene, blends of two polypropylenes, and blends of polypropylene and polyethylene, blends of polypropylene and poly(4-methyl-1-pentene), and/or blends of polypropylene and polybutylene. One example of a fiber for the cover web is a polypropylene BMF made from the polypropylene resin "Escorene 3505G" from Exxon Corporation, providing a basis weight of about 25 g/m$^2$ and having a fiber denier in the range 0.2 to 3.1 (with an average, measured over 100 fibers of about 0.8). Another suitable fiber is a polypropylene/polyethylene BMF (produced from a mixture comprising 85 percent of the resin "Escorene 3505G" and 15 percent of the ethylene/alpha-olefin copolymer "Exact 4023" also from Exxon Corporation) providing a basis weight of about 25 g/m$^2$ and having an average fiber denier of about 0.8. Suitable spunbond materials are available, under the trade designations "Corosoft Plus 20", "Corosoft Classic 20" and "Corovin PP-S-14", from Corovin GmbH of Peine, Germany, and a carded polypropylene/viscose material available, under the trade designation "370/15", from J. W. Suominen OY of Nakila, Finland.

Cover webs that are used in the invention preferably have very few fibers protruding from the web surface after processing and therefore have a smooth outer surface. Examples of cover webs that may be used in the present invention are disclosed, for example, in U.S. Pat. No. 6,041,782 to Angadjivand, U.S. Pat. No. 6,123,077 to Bostock et al., and WO 96/28216A to Bostock et al.

Respirator Components

The strap(s) that are used in the harness may be made from a variety of materials, such as thermoset rubbers, thermoplastic elastomers, braided or knitted yarn/rubber combinations, inelastic braided components, and the like. The strap(s) may be made from an elastic material such as an elastic braided material. The strap preferably can be expanded to greater than twice its total length and be returned to its relaxed state. The strap also could possibly be increased to three or four times its relaxed state length and can be returned to its original condition without any damage thereto when the tensile forces are removed. The elastic limit thus is preferably not less than two, three, or four times the length of the strap when in its relaxed state. Typically, the strap(s) are about 20 to 30 cm long, 3 to 10 mm wide, and about 0.9 to 1.5 mm thick. The strap(s) may extend from the first tab to the second tab as a continuous strap or the strap may have a plurality of parts, which can be joined together by further fasteners or buckles. For example, the strap may have first and second parts that are joined together by a fastener that can be quickly uncoupled by the wearer when removing the mask body from the face. An example of a strap that may be used in connection with the present invention is shown in U.S. Pat. No. 6,332,465 to Xue et al. Examples of fastening or clasping mechanism that may be used to joint one or more parts of the strap together is shown, for example, in the following U.S. Pat. No. 6,062,221 to Brostrom et al., U.S. Pat. No. 5,237,986 to Seppala, and EP1,495,785A1 to Chien. The straps also may be ear loop straps like the strap shown in U.S. Pat. No. 6,394,090 to Chen et al.

As indicated, an exhalation valve may be attached to the mask body to facilitate purging exhaled air from the interior gas space. The use of an exhalation valve may improve wearer comfort by rapidly removing the warm moist exhaled air from the mask interior. See, for example, U.S. Pat. Nos. 7,188,622, 7,028,689, and 7,013,895 to Martin et al.; U.S. Pat. Nos. 7,428,903, 7,311,104, 7,117,868, 6,854,463, 6,843,248, and 5,325,892 to Japuntich et al.; U.S. Pat. No. 6,883,518 to Mittelstadt et al.; and RE37,974 to Bowers. Essentially any exhalation valve that provides a suitable pressure drop and that can be properly secured to the mask body may be used in connection with the present invention to rapidly deliver exhaled air from the interior gas space to the exterior gas space.

A nose clip that is used in the present invention may be essentially any additional part that assists in improving the fit over the wearer's nose. Because the wearer's face exhibits in the nose region, a nose clip may be used to better assist in achieving the appropriate fit in this location. The nose clip may comprise, for example, a pliable dead soft band of metal such as aluminum, which can be shaped to hold the mask in a desired fitting relationship over the nose of the wearer and where the nose meets the cheek. An example of a suitable nose clip is shown in U.S. Pat. No. 5,558,089 and Des. 412,573 to Castiglione. Other nose clips are described in U.S. patent application Ser. No. 12/238,737 (filed Sep. 26, 2008); U.S. Publications 2007-0044803A1 (filed Aug. 25, 2005); and 2007-0068529A1 (filed Sep. 27, 2005).

EXAMPLES

Mask Compression Toughness Test

A mask compression toughness test was used to determine the collapse resistance of a mask under a gradual crushing load. Testing was conducted with the perimeter of the mask body attached to an elliptical platform. The platform simulated the two-dimensional projection of a wearer's face. With the mask mounted on the fixture, the assembly was aligned vertically in the compression testing apparatus. A compressive load was then gradually applied to the mask body through a plate, attached to a load cell, which was aligned parallel to the platform and along the center axis of the mask body. The plate was configured as a circular shape with a diameter of 76 millimeters. The plate was centrally located on the mask body so that full contact to the mask body was maintained throughout the compression cycle. The test apparatus used was a TA-XT plus Texture Analyzer available from Micro Systems, Scarsdale, N.Y. The elliptical mask mounting fixture had a major axis length of 155 mm and a minor axis length of 95 mm and a thickness of 3 mm. The mask body perimeter was fixed to the perimeter of the fixture. With the mask body fixed to the plate, the assembly was rigidly mounted into the test apparatus, and the compression cycle was initiated. The x-head speed of the compression plate was 5 mm per second, and the compression load was recorded in grams-force ($g_f$) from the point of contact with the mask body up to crush point of 25 mm. The crushing force was recorded at points over the full compression cycle, and the area under the curve represented by those points was calculated and given as the area under the force-displacement curve. This area value gives a perspective of crush resistance, or toughness, of the test mask and is given in units of mm-$g_f$.

Example 1

A respirator was assembled that had the configuration of the respirator 10 shown in the drawings. This respirator was mounted on the test fixture described in the *Mask Compression Toughness Test* outlined above. The respirator was tested in two configurations: (1) with the flanges extending away from the mask body as in FIG. 2; and (2) with the flanges held in contact with the mask body from strap tension as in FIG. 6 to simulate an in-use configuration. In the first instance, the respirator demonstrated a crush resistance of 4,094 mm-$g_f$; whereas in the second instance the crush resistance was 6613 mm-$g_f$, a 62% improvement.

This invention may take on various modifications and alterations without departing from its spirit and scope. Accordingly, this invention is not limited to the above-described but is to be controlled by the limitations set forth in the following claims and any equivalents thereof This invention also may be suitably practiced in the absence of any element not specifically disclosed herein.

All patents and patent applications cited above, including those in the Background section, are incorporated by reference into this document in total. To the extent there is a conflict or discrepancy between the disclosure in such incorporated document and the above specification, the above specification will control.

What is claimed is:

1. A filtering face-piece respirator that comprises:

(a) a mask body that comprises a major portion that contains one or more layers of filter media and that has first and second flanges located on opposing sides of the major portion, the first and second flanges being capable of folding inwardly towards the major portion; and (b) a harness that comprises first and second straps that each have first and second ends, the first and second ends being secured to the first and second flanges, respectively, such that there are two ends secured to each flange in a spaced apart relationship so that the first strap has a first segment that follows a path above a wearer's ear and the second strap has a second segment that follows a path below the wearer's ear when the respirator is being donned, wherein at least the second strap is placed in tension when the respirator is donned, and wherein such tension causes the first and second flanges to be folded downwardly into contact with the major portion;

wherein the mask body has first and second lines of demarcation on first and second sides of the mask body, respectively, and wherein the first strap is secured to the first and second flanges at a distance of not more than 1 centimeter from the first and second lines of demarcation and the second strap is secured to the first and second flanges at a distance greater than 1.5 centimeters from the first and second lines of demarcation.

2. The filtering face-piece respirator of claim 1, wherein the first strap is secured to the first and second flanges at a distance of not more than 0.75 centimeters from the first and second lines of demarcation and the second strap is secured to the first and second flanges at a distance greater than 2 centimeters from the first and second lines of demarcation.

3. The filtering face-piece respirator of claim 1, wherein the first and second ends of each of the straps are secured to each of the flanges in a line generally parallel to the leading edges.

4. The filtering face-piece respirator of claim 1, wherein each of the first and second lines of demarcation is at least three centimeters long.

5. The filtering face-piece respirator of claim 1, wherein each flange has welds or bonds provided therein to increase flange stiffness.

6. The filtering face-piece respirator of claim 5, wherein the flanges have a flexural modulus of at least 10 Mega Pascals (MPa) and less than 100 MPa.

7. The filtering face-piece respirator of claim 5, wherein the flanges have a flexural modulus of at least 20 Mega Pascals (MPa) and less than 60 MPa.

8. The filtering face-piece respirator of claim 5, wherein the first flange extends away from the first line of demarcation at least one centimeter, and wherein the second flange extends away from the second line of demarcation at least one centimeter.

9. The filtering face-piece respirator of claim 8, wherein the first flange extends away from the first line of demarcation at least two centimeters, and wherein the second flange extends away from the second line of demarcation at least two centimeters.

10. The filtering face-piece respirator of claim 8, wherein the first and second flanges comprise one or more or all of the various layers that comprise the mask body filtering structure.

11. The filtering face-piece respirator of claim 1, wherein an adhesive layer is disposed between layers in the flanges.

12. A filtering face-piece respirator that comprises:

a mask body that comprises a major portion that contains one or more layers of filter media and that has first and second flanges located on opposing sides of the major portion, the first flange being capable of folding downwardly towards the major portion at a first line of demarcation and the second flange being capable of folding downwardly towards the major portion at a second line of demarcation, wherein the first and second lines of demarcation are offset at an angle $\alpha$ of 30 to 45 degrees from a plane that extends perpendicular to a perimeter of the mask body when viewing the mask body from a top or bottom view in a non-opened condition; and a harness that comprises first and second straps that each have first and second ends, each of the first and second flanges has a strap end secured thereto at a distance of at least one centimeter from the respective first and second lines of demarcation, and wherein tension from the first and/or second straps, when the respirator is donned, causes the flange to be folded downwardly into contact with the major portion.

13. The filtering face-piece respirator of claim 12, wherein the first and second straps each are ear loop straps.

14. The filtering face-piece respirator of claim 12, wherein the first and second ends of the second strap are secured to the first and second flanges, respectively, such that each point of securement is spaced the at least one centimeter from the line of demarcation, wherein at least the second strap is placed in tension when the respirator is donned, and wherein such tension causes the first and second flanges to be folded downwardly into contact with the major portion.

15. The filtering face-piece respirator of claim 12, wherein each of the first and second flanges has a strap end secured thereto at a distance of greater than 1.5 centimeters from the first and second lines line of demarcation respectively.

* * * * *